US006095079A

United States Patent [19]

Smidt

[11] Patent Number: 6,095,079

[45] Date of Patent: Aug. 1, 2000

[54] FOLDING PONTOON BOAT

[76] Inventor: Stanley A. Smidt, 716 P Rd., Minden, Nebr. 68959

[21] Appl. No.: 09/344,813

[22] Filed: Jun. 25, 1999

Related U.S. Application Data

[60] Provisional application No. 60/091,434, Jul. 1, 1998.

[51] Int. Cl.[7] ..... B63B 7/00

[52] U.S. Cl. ..... 114/353; 114/61.15

[58] Field of Search ..... 114/61.1, 61.15, 114/61.16, 61.17, 353, 354, 352

[56] References Cited

U.S. PATENT DOCUMENTS

| | | | |
|---|---|---|---|
| D. 390,528 | 2/1998 | Roberson | D12/304 |
| 1,587,209 | 6/1926 | Bauer . | |
| 2,916,748 | 12/1959 | Stahmer . | |
| 3,763,511 | 10/1973 | Sisil . | |
| 4,303,033 | 12/1981 | King | 114/61 |
| 4,829,926 | 5/1989 | Voelkel | 114/61 |
| 5,052,324 | 10/1991 | Lesly | 114/353 |
| 5,074,233 | 12/1991 | Weed | 114/61 |
| 5,315,947 | 5/1994 | Knight | 114/61.15 |
| 5,515,805 | 5/1996 | Johanson | 114/344 |
| 5,651,706 | 7/1997 | Kasper | 440/29 |
| 5,711,240 | 1/1998 | Baker | 114/61 |
| 5,870,966 | 2/1999 | Christian | 114/353 |

*Primary Examiner*—Jesus D. Sotelo
*Attorney, Agent, or Firm*—Zarley, McKee, Thomte Voorhees & Sease; Dennis L. Thomte

[57] ABSTRACT

A folding pontoon boat comprising first and second pontoons having first and second decks secured thereto, respectively, which extend therebetween. The inner sides of the first and second decks are hingedly secured together to enable the boat to be moved between an operative position and a folded condition.

10 Claims, 7 Drawing Sheets

FOLDING PONTOON BOAT

CROSS-REFERENCE TO RELATED APPLICATION

Applicant filed a provisional application as a small entity entitled "COLLAPSIBLE BOAT" which was accorded Ser. No. 60/091,434 and a filing date of Jul. 1, 1998.

BACKGROUND OF THE INVENTION

1. Field of the Invention

This invention relates to a folding pontoon boat and more particularly to a folding boat which is lightweight, mobile and durable.

2. Description of the Related Art

Many types of folding boats have been previously provided, but they suffer from many disadvantages. Some prior art folding boats are difficult to move between their folded and operative positions, while other prior art folding boats are too heavy for convenient use. Further, certain of the prior art folding boats require separate trailers to transport the same. Additionally, certain of the prior art folding boats do not have adequate flotation. Yet another disadvantage of the prior art boats is that they occupy a large amount of space when in their folded positions.

SUMMARY OF THE INVENTION

A folding pontoon boat is disclosed which includes first and second elongated pontoons having forward and rearward ends. First and second, generally rectangular decks are hingedly connected together at their inner sides and are secured to the first and second pontoons at their outer sides, respectively. First and second support leg assemblies are typically secured at their lower ends to the first and second pontoons, respectively, and extend upwardly therefrom. A connection means operatively pivotally connects the upper ends of the first and second leg assemblies and supports a seat thereon. A brace extends from the connection means downwardly to one of the first and second decks. Third and fourth support leg assemblies are pivotally secured at their lower ends to the first and second pontoons, respectively, and extend upwardly therefrom rearwardly of the first and second support leg assemblies. A connection means pivotally connects the upper ends of the third and fourth leg assemblies. A brace extends from the connection means which connects the upper ends of the third and fourth leg assemblies and extends downwardly to one of the decks. A seat is also provided on the connection means which connects the upper ends of the third and fourth leg assemblies. The boat is pivotally movable from an operative position, wherein the first and second decks extend substantially horizontally between the first and second pontoons, to a folded position wherein the first and second pontoons are closely positioned together with the first and second decks extending upwardly therefrom. The first and second decks include flotation therein, preferably comprised of a closed cell polyethylene material. The boat also includes first and second wheels which are selectively secured to the first and second pontoons adjacent the rearward ends thereof for supporting the rearward ends of the first and second pontoons above the ground when the boat is in its folded or collapsed position.

It is a principal object of the invention to provide an improved folding boat.

A further object of the invention is to provide a folding boat which is designed for mobility and durability.

Yet another object of the invention is to provide a folding boat which is preferably constructed of strong, lightweight aluminum having closed cell polyethylene flotation material associated therewith.

Still another object of the invention is to provide a folding boat which is easily folded in the middle thereof for easy transport and storage.

Still another object of the invention is to provide a folding boat which is easy to transport and easy to launch.

Yet another object of the invention is to provide a folding boat which is stable in use and is unswampable.

Yet another object of the invention is to provide a folding boat which may be transported in a full-size pickup truck with the tailgate closed and when the boat is in its folded position.

Yet another object of the invention is to provide a folding boat which fits between the fender wells on small pickup trucks when the boat is in its folded position.

Still another object of the invention is to provide a folding boat of the type described which may be mounted on a platform supported by a hitch at the rear of a recreational vehicle.

These and other objects of the invention will be apparent to those skilled in the art.

DESCRIPTION OF THE PREFERRED EMBODIMENT

Figure 1:
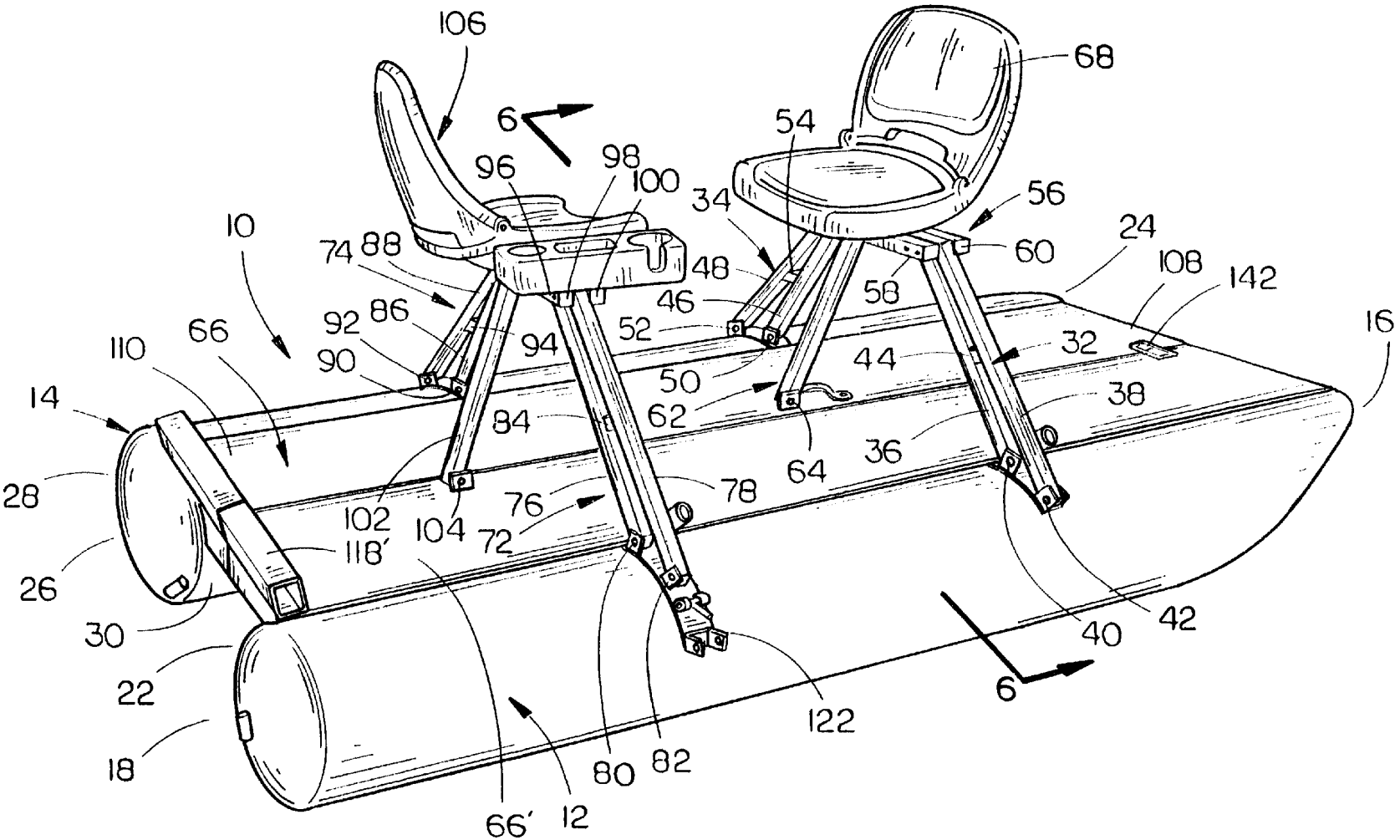
FIG. 1 is a perspective view of the boat of this invention in its operative position.

The folding boat of this invention is referred to generally by the reference numeral 10 and includes elongated pontoons 12 and 14 which are preferably constructed of aluminum. Pontoon 12 will be described as having a forward end 16, rearward end 18, an outer side 20 and an inner side 22. Pontoon 14 will be described as having a forward end 24, rearward end 26, outer side 28 and an inner side 30. First and second leg assemblies 32 and 34 are provided at the forward ends of pontoons 12 and 14, as illustrated in the drawings. Leg assembly 32 includes legs 36 and 38 pivotally connected at their lower ends to pontoon 12 at 40 and 42, respectively. Stop 44 is mounted on leg 38 for engagement with leg 36 to limit the pivotal movement of the leg assembly 32.

Leg assembly 34 comprises legs 46 and 48 pivotally connected at their lower ends to pontoon 14 at 50 and 52, respectively. Stop 54 is provided on leg 48 for engagement with leg 46 to limit the pivotal movement of the leg assembly 34. A connection means 56 comprised of tubes 58 and 60 which are pivotally secured to and which (extend between the upper ends of the leg assemblies 32 and 34, as illustrated in the drawings. Brace 62 is pivotally connected at its upper end to tube 58 and is selectively connected at its lower end to bracket 64 which is secured to deck 66. Seat 68 is connected to connection means 56 in a rotational fashion for supporting a person thereon.

Although the boat of this invention is believed to be functional with only leg assemblies 32 and 34, together with connection means 56, it is preferred that leg assemblies also be provided rearwardly of the leg assemblies just described, not only for adding stability to the boat, but for also providing a seat for an additional person. To that end, the numerals 72 and 74 refer to third and fourth leg assemblies which extend upwardly from pontoons 12 and 14, respectively. Leg assembly 72 includes a pair of legs 76 and 78 which are pivotally connected at their lower ends to pontoon 12 at 80 and 82, respectively. Stop 84 is provided on leg 78 for engagement with leg 763 to limit the pivotal movement of leg assembly 72. Leg assembly 74 includes a pair of legs 86 and 88 which are pivotally connected at their lower ends to pontoon 14 at 90 and 92, respectively. Stop 94 is provided on leg 86 for engagement with leg 48 to limit the pivotal movement of leg assembly 72. The numeral 96 refers to a connection means which interconnects the upper ends of the leg assemblies 72 and 74. Connection means 96 is comprised of a pair of tubes 98 and 100. Brace 102 is pivotally connected to tube 98 and extends downwardly therefrom, as seen in the drawings. The lower end of brace 102 is selectively removably connected to bracket 104 which is secured to deck 66'. Seat 106 is pivotally connected to connection means 96 for supporting a person thereon.

Deck 66 will be described as having a forward end 108, rearward end 110, an outer side 112 and an inner side 114. Deck 66' will be described as including a forward end 108', rearward end 110', outer side 112' and inner side 114'. Decks 66 and 66'are provided with gasoline-resistant, closed cell polyethylene between the upper and lower ends thereof. Preferably, the upper surfaces of decks 66 and 66' are provided with a slip-resistant material thereon.

Figure 2:
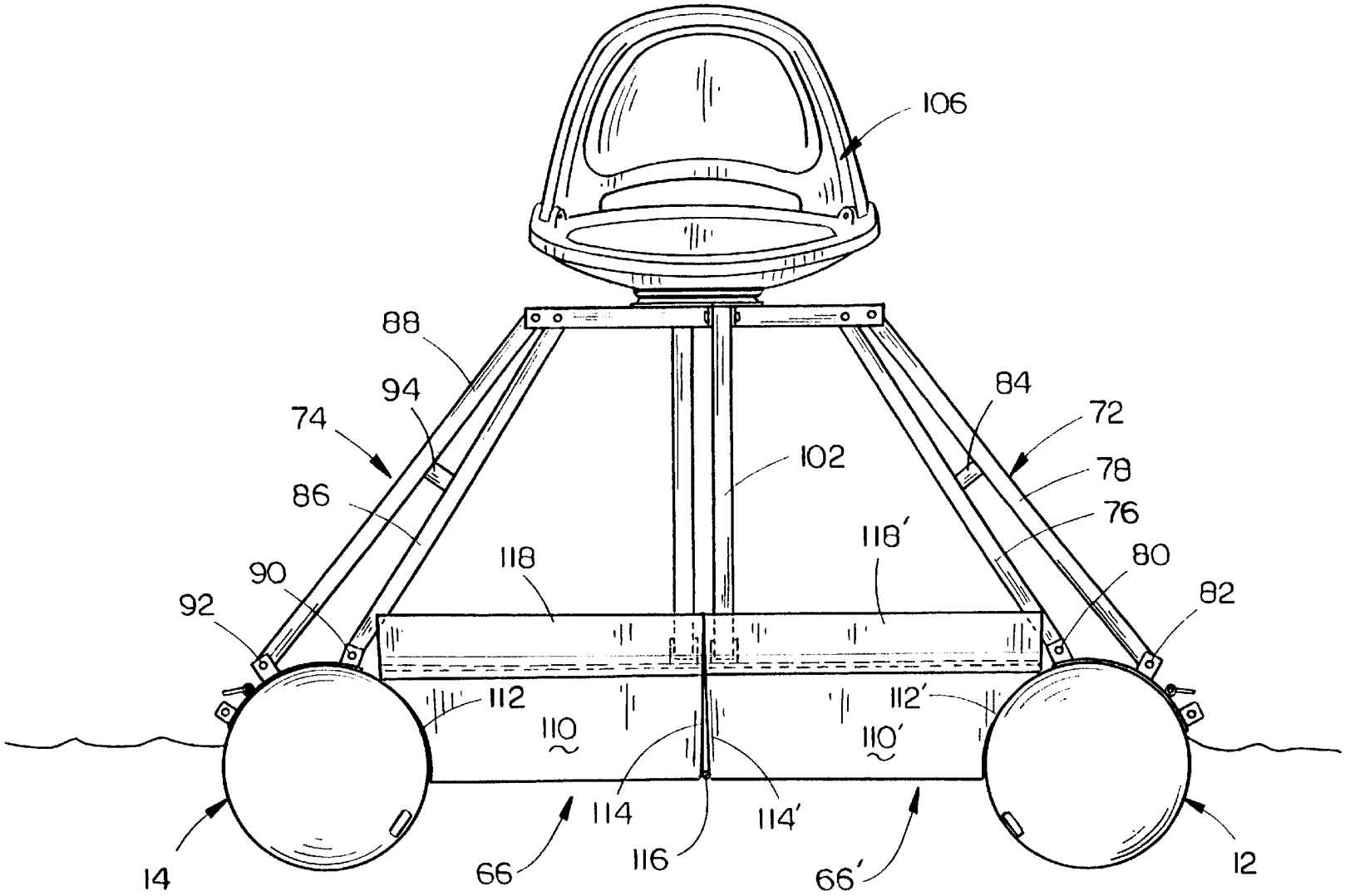
FIG. 2 is a rear view of the boat of FIG. 1.

The outer sides 112 and 112' of decks 66 and 66' are pivotally connected to the inner sides 22 and 30 of pontoons 12 and 14, respectively. The inner sides 114 and 114' of decks 66 and 66' are hingedly connected together adjacent the bottoms thereof by means of a hinge 116. The construction of the boat, as described hereinabove, permits the boat to be folded so that it may be moved between the operative position of FIG. 2 to the folded position of FIG. 3. In the operative position, the decks 66 and 66' are substantially horizontally disposed. In the folded position of FIG. 3, the pontoons 12 and 14 are closely positioned together, as are the bottoms of the decks 66 and 66'. It is preferred that a detachable hook means 115 be provided at the rearward ends of pontoons 12 and 14 which may be hooked together to maintain the boat in its folded condition.

It is preferred also that the rearward ends of decks 66 and 66' be provided with tubular transom members 118 and 118' to enable an outboard motor to be utilized on the boat 10.

It is also preferred that each of the pontoons be provided with a removable wheel assembly. For purposes of description, the wheel assemblies will be described as comprising wheel assemblies 120 and 120'. Inasmuch as wheel assembly 120' is identical to 120, only wheel assembly 120 will be described in detail, with "'" being utilized on wheel assembly 120' to indicate identical structure.

Pontoon 12 includes a U-shaped bracket 122 secured thereto and extending outwardly therefrom and which includes flanges 124 and 126. Positioned just above the U-shaped bracket 122 on pontoon 12 is a hinge pin 128, as illustrated in the drawings. Wheel assembly 120 includes a post 130 having an axle 132 at its lower end upon which the wheel 134 is mounted. Post 130 is provided with a pair of openings 136 and 138 formed therein with the openings 136 and 138 being formed in the post 130 at right angles to one another. Opening 138 is adapted to receive the hinge pin 128 therein while opening 138 is adapted to receive retainer pin 140 which extends through flanges 124 and 126 and the opening 136.

When the post 130 is positioned between the flanges 124 and 126 and the hinge pin 128 extends through opening 138 and the retainer pin 140 extends through opening 136, and when the boat is in its folded condition, the wheel 134 will be in ground engaging condition to support the pontoon 12 above the ground. When it is desired to move the boat from its folded position to its operative position, the retainer pin 140 is removed from the bracket 122 and the post 130 so that the post 130 may be pivoted about the hinge pin 128 to move post 130 from between the flanges 124 arid 126, thereby enabling the wheel assembly to be folded either forwardly or rearwardly about hinge pin 128 so that the wheel assembly will not interfere with the folding operation of the boat.

Figure 3:
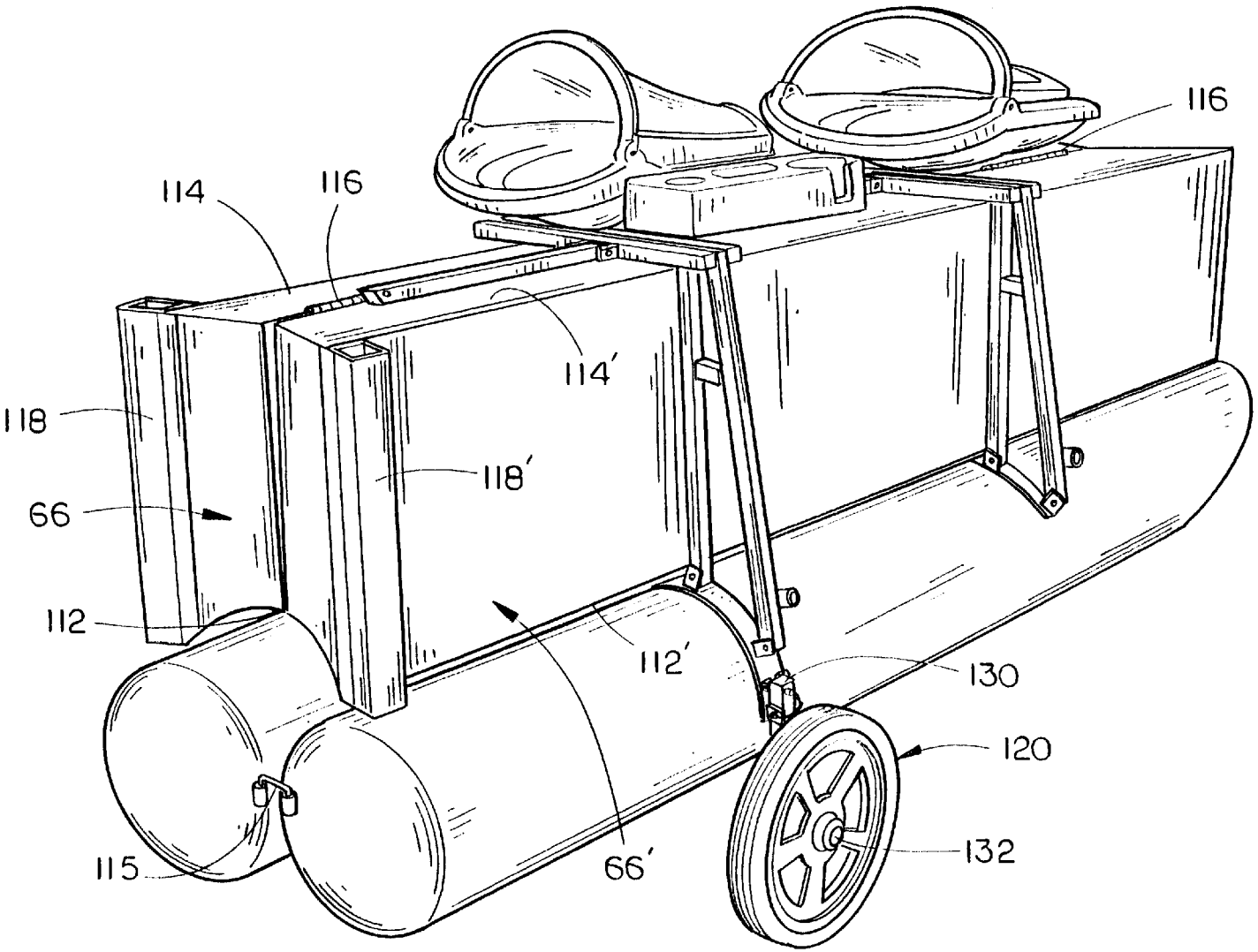
FIG. 3 is a rear perspective view illustrating the boat in its folded position.
Figure 4:
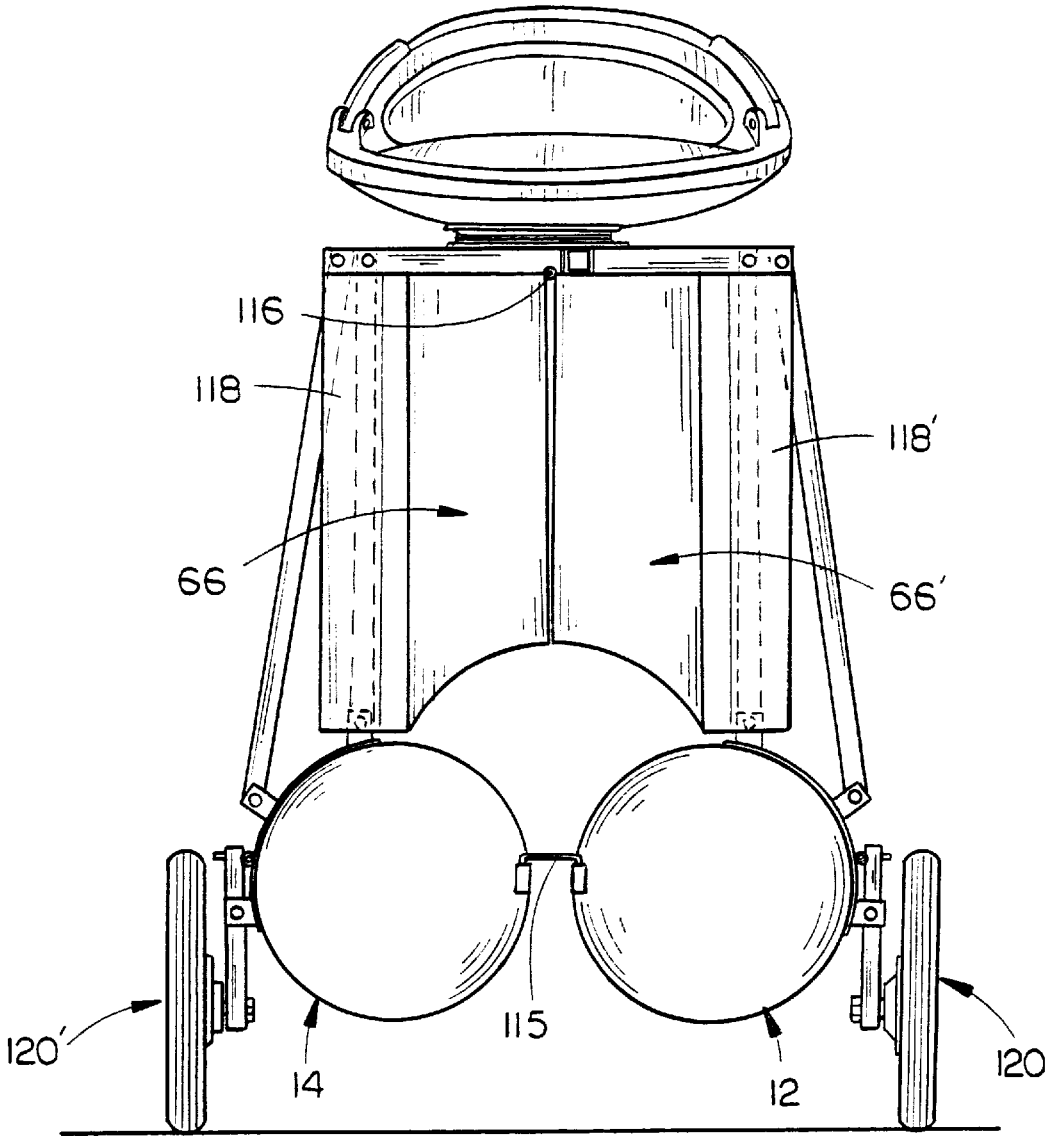
FIG. 4 is a rear view of the boat in its folded position.
Figure 5:
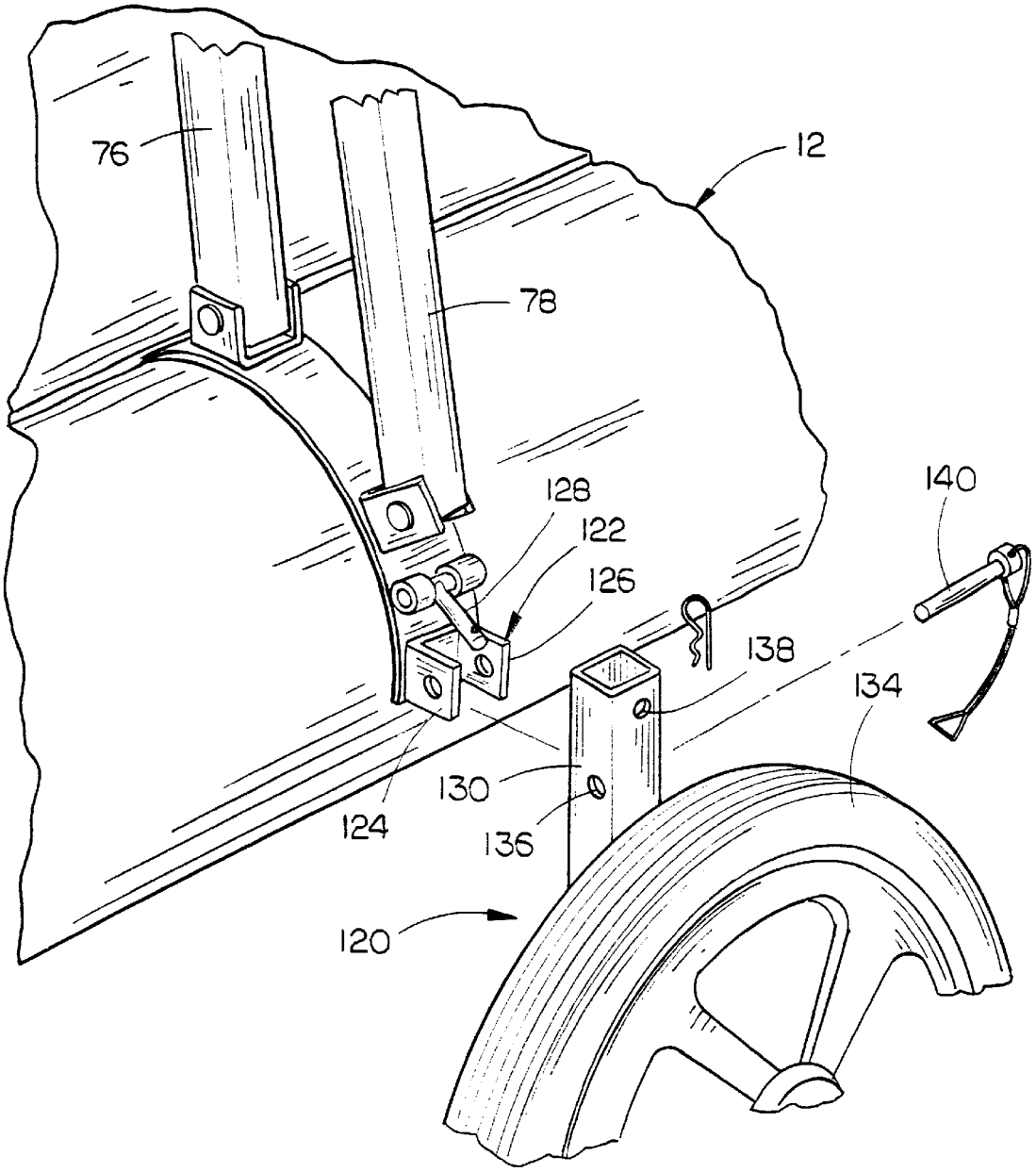
FIG. 5 is an exploded perspective view illustrating the manner in which one of the transport wheels is secured to the boat.
Figure 6:
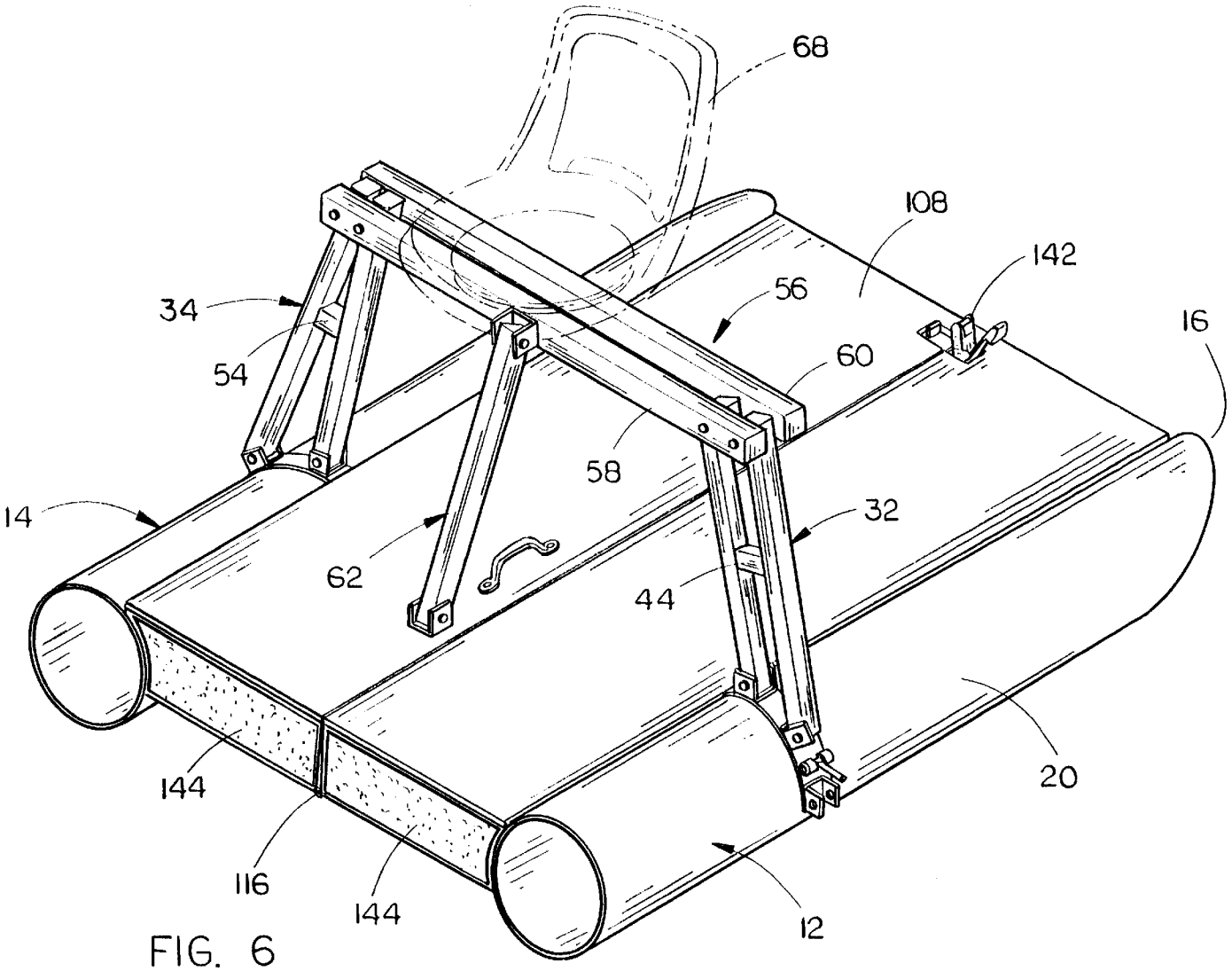
FIG. 6 is a rear perspective view of the boat with portions thereof cut away to more fully illustrate the invention.

Assuming that the boat is in its folded condition of FIG. 3, the connection means 115 connecting the pontoons 12 and 14 together is disconnected so that the pontoons 12 and 14 may be separated. If wheel assemblies are being used, the wheel assemblies 120 and 120' are moved from their operative positions to their folded positions. The pontoons 12 and 14 are then moved apart so that the decks 66 and 66' may pivotally or hingedly move from their upright position to their horizontal position about hinge 116. When the decks 66 and 66' are in their horizontal positions, the latch 142 is locked. The braces 62 and 102 are then folded downwardly and are connected to the brackets 64 and 104, respectively. In its operative position, the boat is extremely stable, lightweight, mobile and durable.

Figure 7:
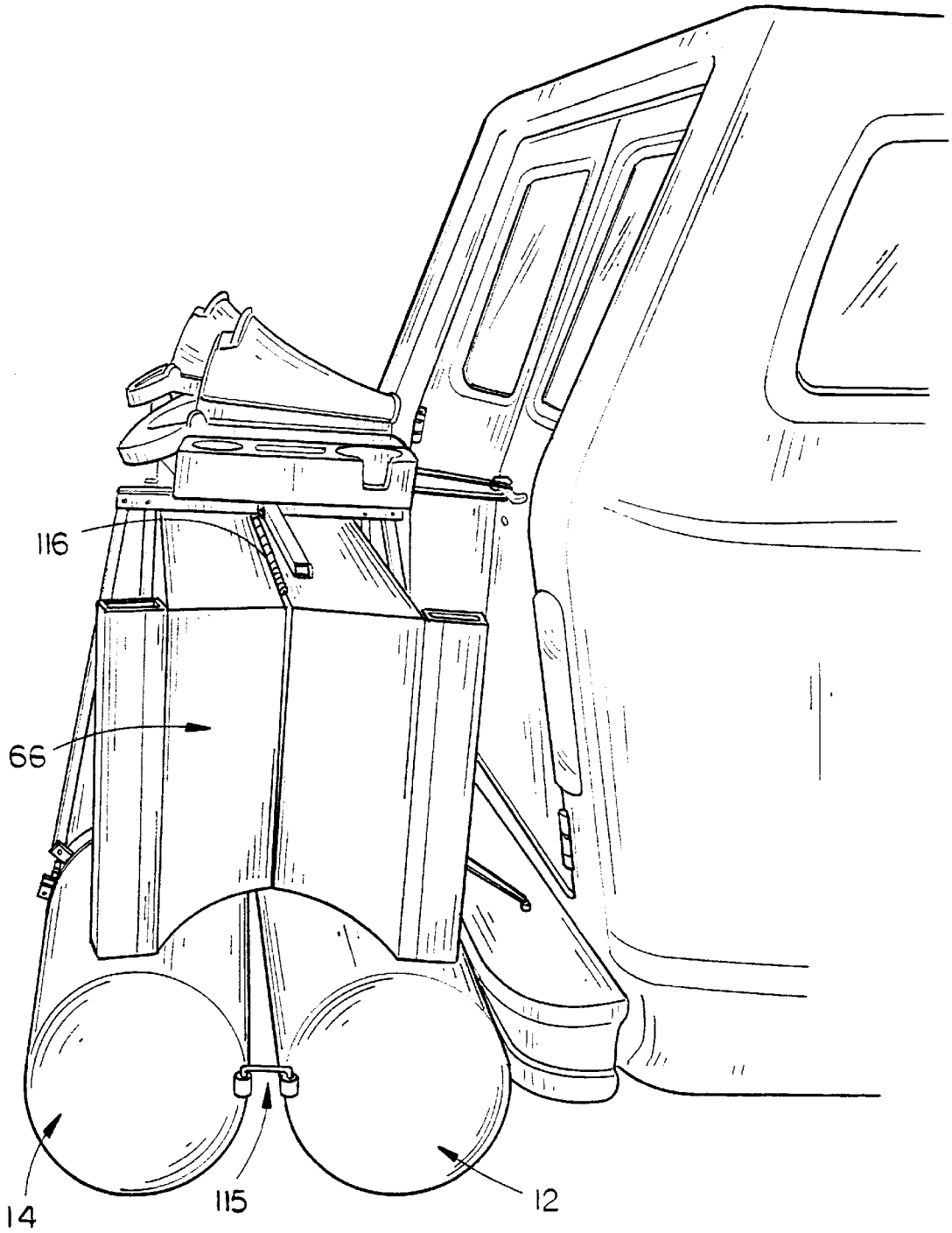
FIG. 7 is a perspective view illustrating the boat in its folded position mounted on the rear of a recreational vehicle.

When it is desired to move the boat from its operative position to its folded position, the braces 62 and 102 are disconnected from the brackets 64 and 104, respectively, and the latch or latches 142 are released. The pontoons 12 and 14 are then moved towards one another, which causes the decks 66 and 66' to be moved from their Horizontal position to their upright position. The pontoons 12 and 14 may then be connected together by means of the connection means 115 to maintain the boat in its folded condition. The wheel assemblies 120 and 120'may then be positioned so as to be in ground engagement to enable the boat to be conveniently moved from one location to another location. The size of the boat is such that it may be mounted on a hitch behind a recreational vehicle (FIG. 7) or may be mounted in the bed of a full-size pickup truck with the tailgate closed. Further, the size of the boat is such that it may be received in the bed of a small pickup between the wheel wells thereof.

Thus it can be seen that the invention accomplishes at least all of its stated objectives.

I claim:

1. A folding pontoon boat, comprising:

a first, elongated pontoon having forward and rearward ends;

a second, elongated pontoon having forward and rearward ends;

a first, generally rectangular deck having a forward end, a rearward end, a bottom, a top, and inner and outer sides;

a second, generally rectangular deck having a forward end, a rearward end, a bottom, a top, and inner and outer sides;

a first hinge means hingedly connecting said inner sides of said first and second decks;

said outer sides of said first and second decks being secured to said first and second pontoons, respectively;

a first support leg assembly, having upper and lower ends, pivotally secured at its said lower end to said first pontoon and extending upwardly therefrom;

a second support leg assembly, having upper and lower ends, pivotally secured at its said lower end to said second pontoon and extending upwardly therefrom;

connection means operatively pivotally connecting said upper ends of said first and second leg assemblies together;

an upstanding brace extending from said connection means to one of said first and second decks;

and a first seat at the upper ends of said first and second leg assemblies;

the boat being pivotally movable from an operative position, wherein said first and second decks extend horizontally between said first and second pontoons, to a folded position wherein said first and second pontoons are closely positioned together with said first and second decks extending upwardly therefrom.

2. The boat of claim 1 wherein said bottoms of said decks are closely positioned together when the boat is in its said folded position.

3. The boat of claim 1 wherein flotation is provided between said tops and bottoms of said first and second decks.

4. The boat of claim 3 wherein said flotation comprises a closed cell polyethylene material.

5. The boat of claim 1 first including means for maintaining the boat in its said folded position.

6. The boat of claim 1 wherein first and second wheels are secured to said first and second pontoons for supporting said first and second pontoons above the ground when the boat is in its said folded position.

7. The boat of claim 1 further including means for maintaining the boat in its said operative position.

8. The boat of claim 1 wherein a third support leg assembly, having upper and lower ends, is pivotally secured at its said lower end to said first pontoon and extends upwardly therefrom and wherein a fourth support leg assembly, having upper and lower ends, is pivotally secured at its said lower end to said second pontoon and extends upwardly therefrom and further wherein a connection means operatively pivotally connects said upper ends of said third and fourth leg assemblies together.

9. The boat of claim 8 wherein a seat is secured to said connection means which pivotally connects said upper ends of said third and fourth leg assemblies together.

10. The boat of claim 1 wherein the rearward ends of said first and second decks have a transom member secured thereto.

* * * * *